United States Patent [19]

Morrow et al.

[11] Patent Number: 4,538,053

[45] Date of Patent: Aug. 27, 1985

[54] TERMINATION APPARATUS FOR HEATERS IN HAZARDOUS ENVIRONMENTS

[75] Inventors: Danny G. Morrow, La Honda; Thomas Y. Oiwa, San Mateo, both of Calif.

[73] Assignee: Raychem Corporation, Menlo Park, Calif.

[21] Appl. No.: 457,295

[22] Filed: Jan. 11, 1983

[51] Int. Cl.[3] ..... H05B 3/08

[52] U.S. Cl. ..... 219/541; 174/65 SS; 174/77 R; 219/523; 277/119; 285/341; 338/273

[58] Field of Search ..... 219/205, 523, 535, 541, 219/552; 114/114; 285/161, 341; 16/2; D8/356; 227/55; 29/235; 174/65 SS, 77 R, 93; 339/89 M, 30; 246/428; 338/273, 274; 277/102, 110, 112, 115, 119

[56] References Cited

U.S. PATENT DOCUMENTS

| | | | |
|---|---|---|---|
| 259,449 | 6/1882 | Woodring | 277/119 X |
| 1,074,663 | 10/1913 | Sudekum | 277/119 |
| 1,223,688 | 4/1917 | Gary | 277/119 X |
| 1,345,473 | 7/1920 | Benjamin | 174/65 SS |
| 1,396,714 | 11/1921 | Carmichael | 277/119 X |
| 1,788,366 | 1/1931 | Anderson | 174/65 SS X |
| 2,118,855 | 5/1938 | Miller | 277/119 |
| 2,533,462 | 12/1950 | Ingram | 174/77 R X |
| 2,542,583 | 2/1951 | Shea, Jr. | 174/77 R |
| 3,055,972 | 9/1962 | Peterson | 174/65 SS X |
| 3,176,064 | 3/1965 | Browne | 174/77 R X |
| 3,233,202 | 2/1966 | Kyle | 219/541 X |
| 3,244,796 | 4/1966 | Stark et al. | 174/77 R |
| 3,371,150 | 2/1968 | Bachman | 174/65 SS |
| 3,493,670 | 2/1970 | Broadbelt et al. | 174/65 SS |
| 3,567,843 | 3/1971 | Collins et al. | 174/65 SS X |
| 3,601,526 | 8/1971 | Bohne et al. | 174/65 SS X |
| 4,022,966 | 5/1977 | Gajajiva | 174/65 SS |
| 4,030,741 | 6/1977 | Fidrych | 174/65 SS X |
| 4,238,640 | 12/1980 | Tweed et al. | 219/541 X |
| 4,387,267 | 6/1983 | Becker | 174/65 SS |
| 4,388,523 | 6/1983 | Keep, Jr. et al. | 219/541 |

*Primary Examiner*—Volodymyr Y. Mayewsky
*Attorney, Agent, or Firm*—Stephen C. Kaufman; Timothy H. P. Richardson; Herbert G. Burkard

[57] ABSTRACT

Termination apparatus for elongate heaters which have an outer metal sheath and which are designed for use in hazardous environments. The apparatus comprises a junction box within which the heater is terminated and which has an entry port through which the heater enters the junction box. Secured to the entry port is a connection member comprising first and second compression members which surround a heater passing through the entry port and which define between them a chamber. Within the chamber is a grommet which is composed of lead or another deformable metal. The compression members can be drawn together, thus reducing the size of the chamber between them and deforming the grommet into close conformity with the metal sheath of the heater. In this way, if flames are generated within the junction box, they cannot ignite explosive gases surrounding the junction box.

8 Claims, 3 Drawing Figures

TERMINATION APPARATUS FOR HEATERS IN HAZARDOUS ENVIRONMENTS

BACKGROUND OF THE INVENTION

1. Field of the Invention

This invention relates to termination apparatus for use with elongate heaters in hazardous environments.

2. Introduction to the Invention

Elongate heaters of various kinds are known. They include both parallel cut-to-length heaters, for example self-regulating conductive polymer strip heaters, zone heaters and mineral-insulated cables. When such heaters are to be used in hazardous environments (where regulations require compliance with stringent precautions to prevent sparks or flames which could cause explosion or ignition of gases in the surrounding atmosphere), they are usually provided with an outer metal sheath, which may be corrugated to provide a degree of flexibility. Within the junction boxes in which the heater is terminated, the metal sheath is removed so that connection to the heater can be made. The heater enters the junction box through an entry port, which is of course somewhat larger than the cross-section of the heater. Regulations require the the entry port should be sealed in some way which prevents flames generated within the junction box from passing through the entry port to the atmosphere surrounding the junction box. Compliance with these regulations has proved to be difficult and expensive, due at least in part to the fact that the metal sheath does not have a completely regular cross-section, especially when it is corrugated, so that it is not possible to preform a grommet which conforms sufficiently closely to the sheath to provide the required flame control.

SUMMARY OF THE INVENTION

We have now discovered that compliance with the relevant safety regulations can be accomplished through use of a grommet which is composed of lead or like deformable metal. We have found that such a grommet can be deformed into close conformity with the metal sheath of the heater, without substantially deforming the sheath, even when it is corrugated, thus ensuring substantial conformance of the grommet to irregularities in the corrugated sheath, while preserving a long path length for any very small passageways which remain between the grommet and the heater.

In one aspect, the invention provides termination apparatus which is suitable for use in the installation of elongate heaters in hazardous environments, especially heaters having corrugated metal outer sheaths, and which comprises (1) a junction box having an entry port through which an elongate heater having a metal outer sheath can be passed for termination within the junction box;

(2) a connection member which is secured to the entry port and which comprises (a) a first compression member which surrounds a heater passing through the entry port, (b) a second compression member which surrounds a heater passing through the entry port, the first and second compression members defining between them a chamber having walls spaced apart from a heater passing through the compression members and the entry port.

(c) compression means for drawing the first and second compression members towards each other along the axis of a heater passing through them, thus reducing the size of the chamber defined by the first and second compression members, and (d) a grommet which is adapted to be placed within the chamber defined by the first and second compression members, which is composed of a deformable metal, which has a passageway therethrough conforming generally to the shape of a heater to be passed through the passageway, and which can be deformed into close conformity with a heater passing through the passageway by drawing the first and second compression members towards each other.

In another aspect, the invention provides a heater assembly for use in hazardous areas, which assembly comprises (1) a junction box having an entry port;

(2) an elongate heater having a metal outer sheath, the heater passing through the entry port of the junction box and being terminated within the junction box;

(3) a connection member which is secured to the entry port and to the heater so that flames within the junction box cannot pass through the entry port into the atmosphere surrounding the junction box, the connection member comprising (a) a first compression member surrounding the heater, (b) a second compression member surrounding the heater, the first and second compression members defining between them a chamber having walls spaced apart from the heater, (c) compression means for drawing the first and second compression members towards each other along the axis of the heater, thus reducing the size of the chamber defined by the first and second compression members, and (d) a grommet which lies within the chamber defined by the first and second compression members, which is composed of a deformable metal, through which the heater passes, and which has been deformed into close conformity with the metal outer sheath of the heater by drawing the first and second compression members towards each other.

BRIEF DESCRIPTION OF THE DRAWING

The invention is illustrated in the accompanying

DETAILED DESCRIPTION OF THE INVENTION

Figures 1, 2, 3:
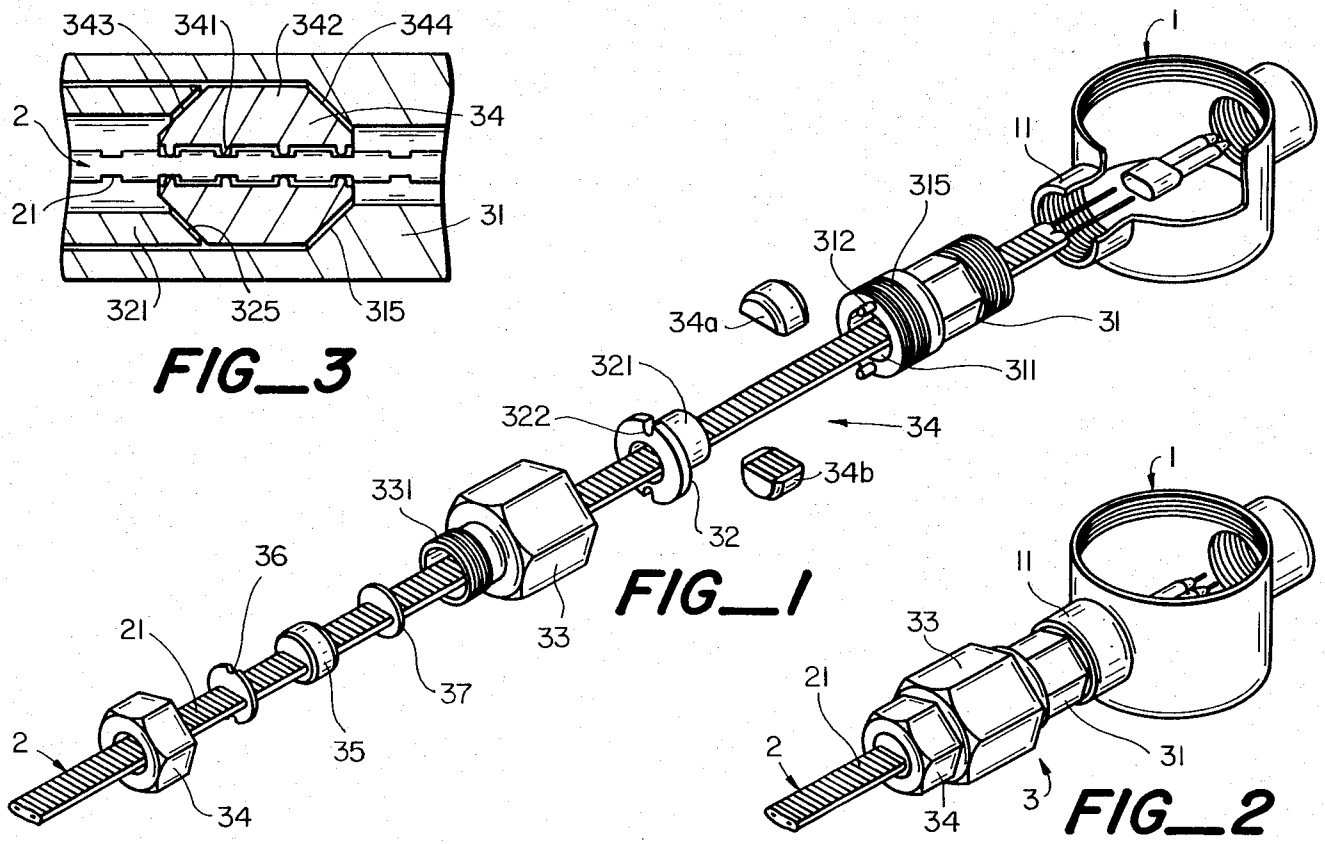
FIG. 1 is an exploded isometric view of an assembly of the invention.
FIG. 2 is an isometric view of a completed assembly of the invention.
FIG. 3 is a cross-section through part of an assembly of the invention before deformation of the grommet.

The grommets used in the invention are composed of a deformable metal, preferably lead or an alloy of lead preferably containing at least 90% by weight of lead. The grommet can be solid or can contain voids to reduce the deformation forces required.

It is usually convenient for the grommet to be axially split into two or more parts, so that it can be fitted around the heater without requiring access to a free end thereof. When, as is often the case, the outer metal sheath of the heater is corrugated, the interior surface of the grommet preferably is formed with a plurality of transverse ribs corresponding generally to the corrugations of the sheath. Such ribs are preferably spaced apart from each other by a distance equal to the spacing of the corrugations and are of similar height to the corrugations, but are not as wide as, e.g. 0.3 to 0.8 times the width of, the corrugated troughs into which they fit, thus allowing for variation in the spacing of the corrugations.

The metal grommet, which is generally circular in exterior cross-section, should be of sufficient length (e.g. 1.2 to 3.5 cm) to ensure a sufficient path length for flames generated within the junction box; the path is of course serpentine when the heater has a corrugated outer metal sheath. The grommet and the compression members should be shaped so that when the compression members are drawn towards each other, the desired deformation of the grommet is achieved. Preferably the compressive forces acting on the grommet are only in the axial direction; for example relative rotation of the compression members should preferably be avoided. Preferably the grommet is not shortened by the deformation thereof. It is also preferable that the whole length of the grommet should be deformed so that the whole of the passage therethrough conforms to the heater; this can be achieved by suitable selection of the diameter to length ratio of the grommet and the shape of the bearing surfaces of the compression members. We have obtained excellent results using a grommet which has a cylindrical center section and inwardly tapered, preferably frusto-conical, end sections, in combination with compression members which have outwardly tapered, preferably inverse frusto-conical, bearing surfaces which bear upon the grommet. Preferably the bearing surfaces do not contact a center portion of the end sections of the grommet, so that the resultant forces do not act to shorten the grommet, as shown for example in FIG. 3. The angle of the frusto-conical sections is preferably in the range of 20° to 60°, preferably 20° to 40°, e.g. about 27°.

Referring now to the drawing, FIGS. 1 and 2 show an elongate heater 2 which has an outer corrugated metal sheath 21 and which passes through a connection member 3 into a junction box 1 via an entry port 11. Connection member 3 comprises a first compression member 31, a scond compression member 32 and compression nut 33. The connection member 3 is secured to the junction box 1 by threaded portions on the member 31 and the entry port 11. Member 32 has a cylindrical portion 321 which fits within hollow cylindrical portion 311 of member 31 to define a chamber. Internally threaded compression nut 33 engages externally threaded end 315 of member 31 and can be rotated to force member 32 into member 31, thus reducing the size of the chamber between them. Pins 312 on member 31 engage channels 322 in member 32 to prevent relative rotation of the two compression members when compression nut 3 is rotated. Grommet, which is composed of lead, is axially split into two halves 34*a* and 34*b* and is sized to fit into the chamber between the members 31 and 32 and around the corrugated sheath 21 of the heater 2, as shown in detail in FIG. 3. The interior surface of the grommet is formed with transverse ribs 341 corresponding generally to, but narrower than, the corrugations on the metal sheath of the heater. The exterior of the grommet has a cylindrical center section 342 and frusto-conical end portions 343 and 344, and compression members 31 and 32 have complementary inverse frusto-conical bearing sections 315 and 325. When the compression nut 33 is tightened, the grommet 34 is deformed into close conformity with the corrugated metal sheath of the heater and with the walls of the chamber. The connection member 3 is completed by a second compression nut 34 which engages externally threaded end portion 331 of compression nut 33 and compresses elastomeric grommet 35 between pressure plates 36 and 37, to prevent moisture from wicking into the connection member.

We claim:

1. Termination apparatus for terminating an elongate electrical heater having an outer metal sheath, the apparatus comprising (1) a junction box having an entry port through which an elongate heater having a metal outer sheath can be passed for termination within the junction box;

(2) a connection member which is secured to the entry port and which comprises (a) a first compression member which surrounds a heater passing through the entry port, (b) a second compression member which surrounds a heater passing through the entry port, the first and second compression members defining between them a chamber having walls spaced apart from a heater passing through the compression members and the entry port, (c) compression means for drawing the first and second compression members towards each other, without rotating the members relative to each other, along the axis of a heater passing through them, thus reducing the size of the chamber defined by the first and second compression members, and (d) a grommet which is adapted to be placed within the chamber defined by the first and second compression members, which is composed of lead and is split axially into at least two parts, which has a passageway therethrough conforming generally to the shape of a heater to be passed through the passageway, and which can be deformed into close conformity with a heater passing through the passageway by drawing the first and second compression members towards each other, the grommet having frusto-conical end sections and the compression members having complementary inverse frusto-conical heating surfaces which bear upon said frusto-conical end sections.

2. Apparatus according to claim 1 wherein the grommet is composed of an alloy of lead containing at least 90% by weight of lead.

3. Apparatus according to claim 1 wherein the passageway through the grommet has transverse ribs corresponding to corrugations in the outer sheath of the heater.

4. Apparatus according to claim 3 wherein the ribs are narrower than the corrugations.

5. Apparatus according to claim 1 wherein the angle of the frusto-conical sections is in the range 20° to 40°.

6. A heater assembly for use in hazardous areas, which assembly comprises (1) a junction box having an entry port;

(2) an elongate electrical heater having a metal outer sheath, the heater passing through the entry port of the junction box and being terminated within the junction box;

(3) a connection member which is secured to the entry port and to the heater so that flames within the junction box cannot pass through the entry port into the atmosphere surrounding the junction box, the connection member comprising (a) a first compression member surrounding the heater, (b) a second compression member surrounding the heater, the first and second compression members defining between them a chamber having walls spaced apart from the heater, (c) compression means for drawing the first and second compression members towards each other, without rotating the members relative to each other, along the axis of the heater, thus reducing the size of the chamber defined by them, and (d) a grommet which lies within the chamber defined by the first and second compression members, which is composed of lead and is split axially into at least two parts, through which the heater passes, and which has been deformed into close conformity with the corrugated sheath of the heater by drawing the first and second compression members towards each other, the grommet having frusto-conical end sections and the compression members having complementary inverse frusto-conical heating surfaces which bear upon said frusto-conical end sections.

7. An assembly according to claim 6 wherein the grommet is composed of an alloy of lead containing at least 90% by weight of lead.

8. An assembly according to claim 6 wherein the outer metal sheath of the heater is corrugated.

* * * * *